US010351402B2

(12) United States Patent
Bullock

(10) Patent No.: US 10,351,402 B2
(45) Date of Patent: Jul. 16, 2019

(54) RIGGING RING

(71) Applicant: 10284343 CANADA INC., Swan River (CA)

(72) Inventor: Cole Bullock, Swan River (CA)

( * ) Notice: Subject to any disclaimer, the term of this patent is extended or adjusted under 35 U.S.C. 154(b) by 0 days.

(21) Appl. No.: 15/924,073

(22) Filed: Mar. 16, 2018

(65) Prior Publication Data

US 2018/0346302 A1 Dec. 6, 2018

Related U.S. Application Data

(60) Provisional application No. 62/512,652, filed on May 30, 2017.

(51) Int. Cl.

| | |
|---|---|
| ***B66F 13/00*** | (2006.01) |
| ***B66D 3/04*** | (2006.01) |
| ***B66C 1/12*** | (2006.01) |
| *B63H 9/10* | (2006.01) |
| *A63B 29/02* | (2006.01) |

(52) U.S. Cl.

CPC ..... *B66F 13/00* (2013.01); *B66C 1/12* (2013.01); *B66D 3/04* (2013.01); *A63B 29/02* (2013.01); *B63H 9/10* (2013.01)

(58) Field of Classification Search

CPC ..... B66F 13/00; A63B 29/02; B63H 9/10; B66D 3/04; B66D 3/06; B66C 1/12

See application file for complete search history.

(56) References Cited

U.S. PATENT DOCUMENTS

| | | | | | |
|---|---|---|---|---|---|
| 1,477,639 | A * | 12/1923 | Fishback | B66D 3/046 | 254/402 |
| 1,771,484 | A * | 7/1930 | Byers | B66D 3/06 | 254/403 |
| 1,857,434 | A * | 5/1932 | Cole | F16G 11/00 | 24/115 K |
| 1,933,011 | A * | 10/1933 | Greve | B66D 3/046 | 254/402 |
| 2,052,074 | A * | 8/1936 | Black | B66D 3/06 | 254/393 |
| 3,733,053 | A * | 5/1973 | Haulotte | B66D 3/04 | 254/409 |
| 4,075,902 | A * | 2/1978 | Charchian | F16H 55/56 | 403/358 |
| D252,069 | S * | 6/1979 | Nava | D8/360 | |
| 5,538,224 | A * | 7/1996 | Powell | B66D 3/04 | 254/406 |
| 6,189,867 | B1 * | 2/2001 | O'Rourke | B66D 3/04 | 254/391 |
| 6,305,669 | B1 * | 10/2001 | Harken | B63H 9/10 | 254/412 |
| 6,371,448 | B1 * | 4/2002 | De Angelis | F16H 55/50 | 254/374 |
| 7,419,138 | B1 * | 9/2008 | Mauthner | B66D 3/08 | 254/391 |

(Continued)

*Primary Examiner* — Michael E Gallion

(74) *Attorney, Agent, or Firm* — Richard D. Okimaw

(57) ABSTRACT

An apparatus for supporting and redirecting a rigging rope comprising a ring having an outer annular surface and a central passage extending between first and second side edges defining an inner surface, wherein the outer surface includes at least two circumferential grooves therearound and wherein the inner surface has a curved cross-sectional profile extending between the first and second side edges.

10 Claims, 3 Drawing Sheets

(56) References Cited

U.S. PATENT DOCUMENTS

| | | | | |
|---|---|---|---|---|
| 8,596,615 | B2 * | 12/2013 | Kommer | B66D 3/10 254/391 |
| 8,727,320 | B1 * | 5/2014 | Franta | B66D 3/04 254/389 |
| 9,187,298 | B2 * | 11/2015 | DeSoo | B66D 3/04 |
| 9,758,358 | B2 * | 9/2017 | Mupende | B66D 1/30 |
| 9,975,743 | B2 * | 5/2018 | Barnet | B63B 21/04 |
| 2003/0000442 | A1 * | 1/2003 | Curchod | B29C 70/46 114/108 |
| 2003/0025109 | A1 * | 2/2003 | Baranda | F16H 55/50 254/266 |
| 2003/0034203 | A1 * | 2/2003 | Hewlett | A62B 1/14 182/5 |
| 2005/0005448 | A1 * | 1/2005 | Tan | B21C 23/14 29/892.3 |
| 2005/0263748 | A1 * | 12/2005 | Smith | B66D 3/04 254/409 |
| 2011/0173780 | A1 * | 7/2011 | Lipke | A62B 1/06 24/115 R |
| 2012/0181493 | A1 * | 7/2012 | Leemans | B66D 1/7415 254/371 |
| 2014/0027691 | A1 * | 1/2014 | Ilaka | B66D 1/30 254/334 |
| 2015/0183624 | A1 * | 7/2015 | Maurice | B66D 3/02 254/399 |
| 2016/0152452 | A1 * | 6/2016 | Barnet | B63B 21/04 254/390 |

* cited by examiner

RIGGING RING

CROSS REFERENCE TO RELATED APPLICATION

This application claims priority to U.S. Provisional Patent Application No. 62/512,652 filed May 30, 2017 entitled Rigging Ring.

BACKGROUND OF THE INVENTION

1. Field of Invention

The present invention relates generally to rope rigging systems and specifically to a low friction rigging ring to support and redirect the rope therethrough.

2. Description of Related Art

Rope rigging systems can be used for a variety of purposes, including rock climbing, sailing and the arboriculture or forestry trade. When using rope rigging systems, the rope direction can be redirected in a number of ways, including with pulleys, blocks or low friction rings. Low friction rings are a low-cost alternative to pulleys and blocks, and are beneficial when loads are not too great. Rings weigh less than pulleys or blocks, which is advantageous when all rigging gear must be carried on the user to the desired site (such as rock climbing or arboriculture).

When supporting large loads, or redirecting a rigging rope over a greater deflection, multiple rings may be used to better support the load and to provide a greater bend radius, as illustrated in FIGS. 1 and 2 at 10. Each low friction ring 12 is supported by one spliced support rope 8 in a groove 14 around the outer circumference of the ring, with the rigging rope 6 passing through the centre of each ring 12. In this configuration, the rigging rope 6 is supported by a plurality of rings 12 therefore increasing the number of locations where the rigging rope 6 contacts the ring material and increasing rigging rope 6 wear as it passes therethrough. With multiple narrow rings, the rope must make a sharp turn to enter the first ring, then flattens out to pass through the remaining rings, then makes another sharp turn to exit the final ring. The sharp turns can cause the rope to wear quickly.

SUMMARY OF THE INVENTION

According to a first embodiment of the present invention there is disclosed an apparatus for supporting and redirecting a rigging rope comprising a ring having an outer annular surface and a central passage extending between first and second side edges defining an inner surface, wherein the outer surface includes at least two circumferential grooves therearound and wherein the inner surface has a curved cross-sectional profile extending between the first and second side edges.

The curved cross-sectional profile may have an arcuate shape. The curved cross-sectional profile may have a constant curvature. The central passage may be round. The central passage may be elliptical.

Each of the at least two circumferential grooves may have a circular cross-sectional profile. The at least two circumferential grooves may be separated by a radial wall therebetween.

The ring may be formed of a material selected from a group consisting of aluminum, aluminum alloys, titanium and steel. The inner surface may be treated to provide a low friction surface. The inner surface may be anodized. The outer surface may be treated to provide a low friction surface. The outer surface may be anodized.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
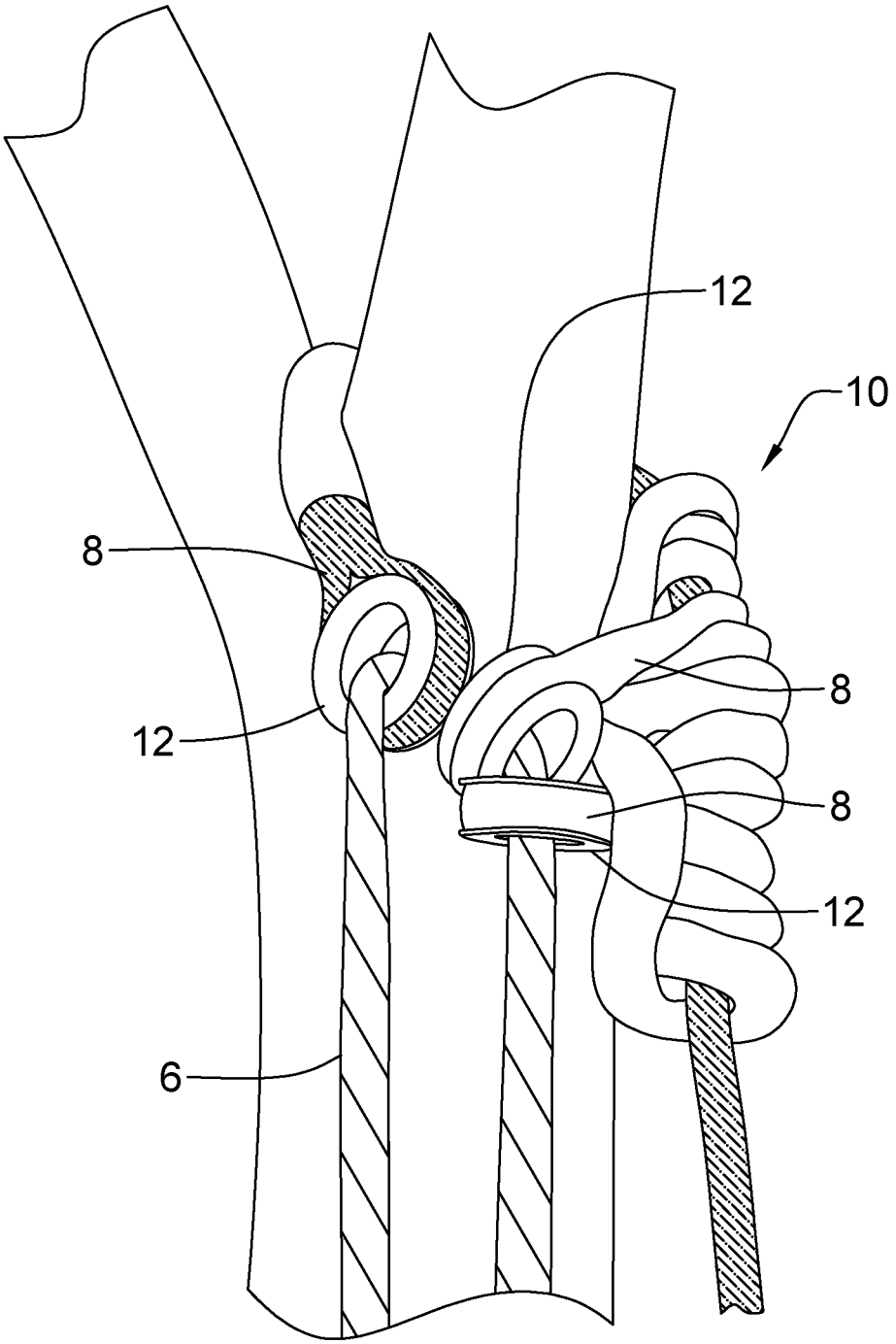
Figure 1 Prior Art
FIG. 1 is a perspective view of prior art low friction rings in use.
Figure 2:
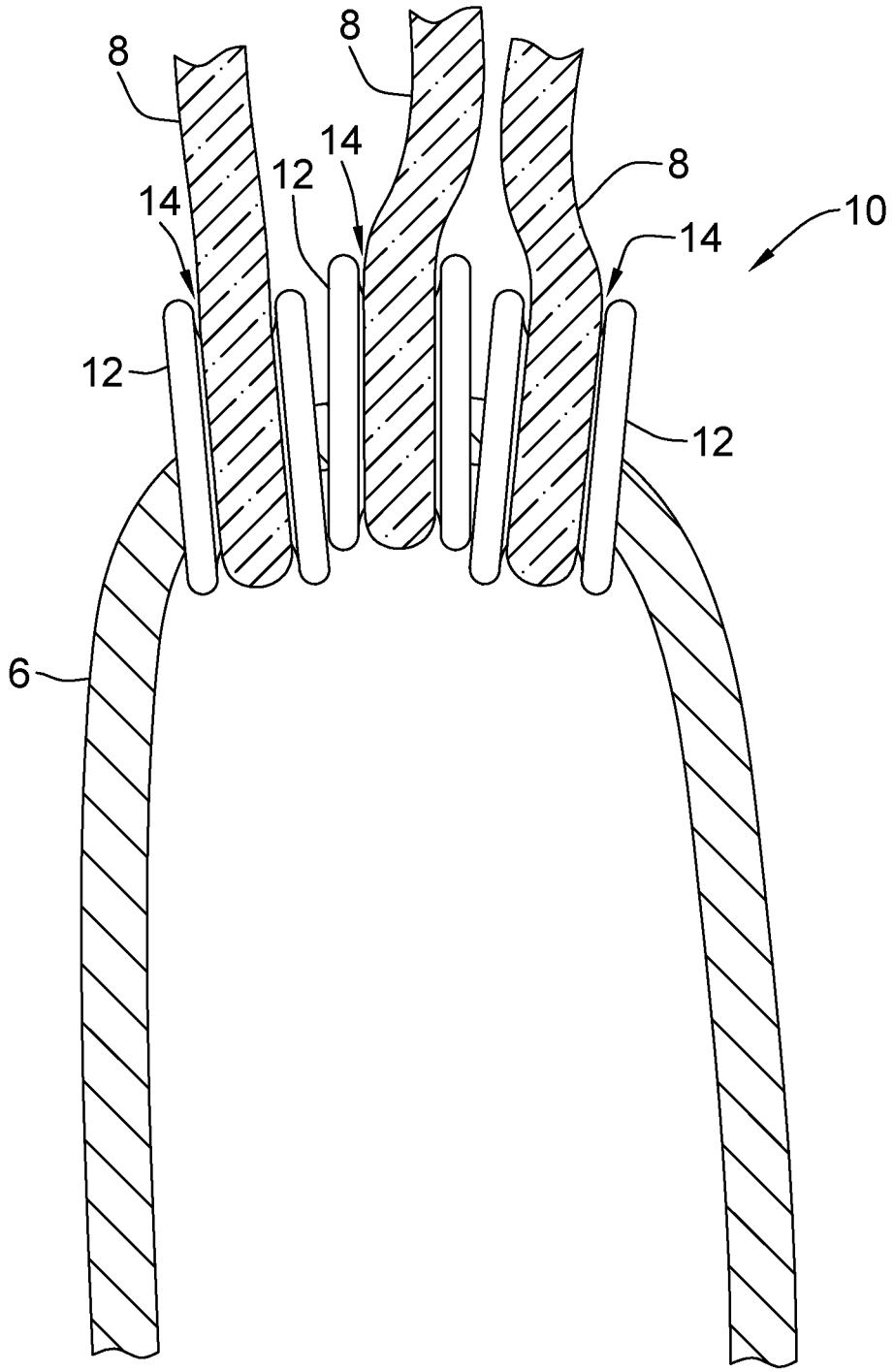
Figure 2 Prior Art
FIG. 2 is a font view of prior art low friction rings in use.
Figure 3A:
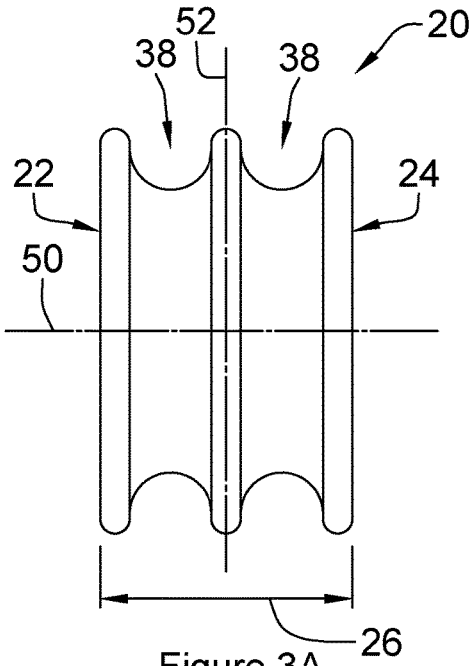
FIG. 3A is a front view of a low friction ring according to a first embodiment of the present invention.
Figure 3B:
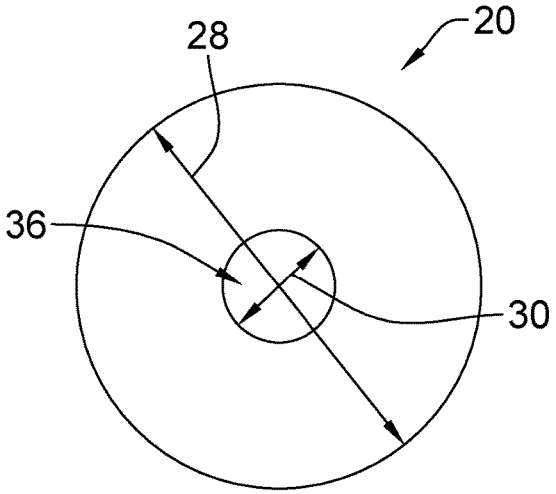
FIG. 3B is a side view of the low friction ring of FIG. 3A.
Figure 3C:
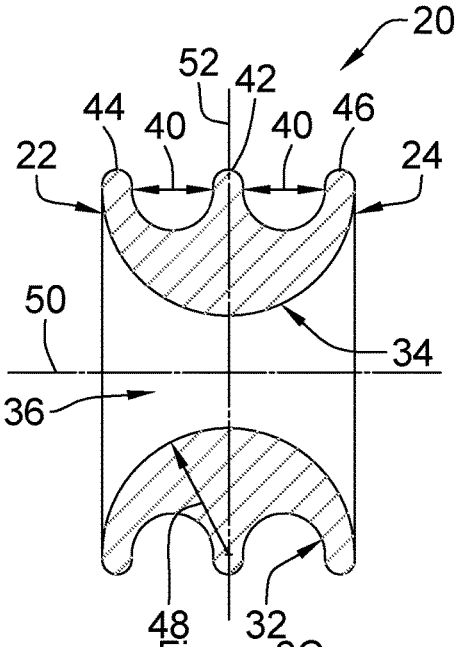
FIG. 3C is a cross-sectional view of the low friction ring of FIG. 3A along the line 3C-3C.

Referring to FIGS. 3A-3C, a low friction ring for supporting and redirecting a rigging rope according to a first embodiment of the invention is shown generally at 20. The low friction ring 20 includes a central passage 36 therethrough and two parallel circumferential rope paths 38, such as a groove therearound. The rope paths 38 each receive a support rope 8, as illustrated in the prior art FIGS. 1 and 2, and the central passage 36 receives a rigging rope 6 therethrough.

The low friction ring 20 extends along a central axis 50 between first and second edges, 22 and 24 respectively, and has a thickness 26, with a mid-point 52. The low friction ring 20 has an outer diameter 28 and an inner diameter 30 at the md-point 52 and includes outside and inside surfaces, 32 and 34, respectively, with a central passage 36 therethrough along the central axis 50.

The rope paths 38 are formed therearound in the outside surface 32. Each rope path 38 has a circular profile adapted to receive a rope therein as is commonly known, with a diameter 40. A circumferential radial wall 42 with outer diameter 28 may separate the two rope paths 38 at the mid-point 52. First and second outer circumferential radial walls 44 and 46, respectively, with outer diameter 28 form the outside edges of the paths 38 at the first and second edges, 22 and 24, respectively. Each path 38 is sized to receive a support rope 8 therein.

The inside surface 34 is formed in an arcuate profile and may have a constant curvature radius 48. As illustrated, the radius 48 may be half of the thickness 26, although it will be appreciated that a larger radius may be used, as well. The inside diameter 30 is sized to receive a rigging rope 6 therethrough, allowing a clearance fit therebetween. It will be appreciated that other non-constant radiuses may be utilized for the inside surface 34 such as providing a decreasing or segmented radius. By way of non-limiting example, the profile of the inside surface may have a greater radius closer to each edge or may include one or more non-radiused regions therealong.

Figure 4:
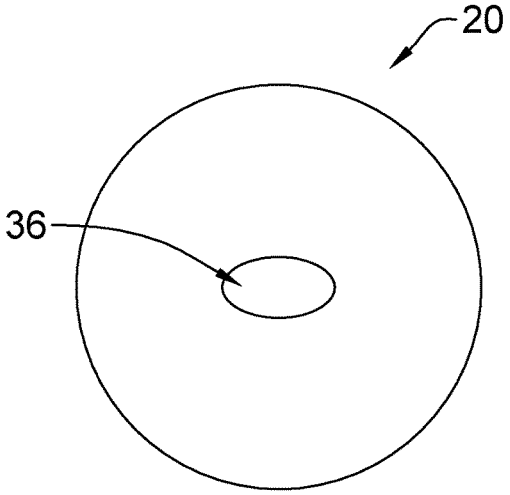
FIG. 4 is a side view of a further embodiment of a low friction ring.

As illustrated in FIG. 3B, the central passage 36 may have a round opening shape. It will be appreciated that the central passage 36 may have a non-round opening shape, as well, such as, by way of non-limiting example, an elliptical profile, as illustrated in FIG. 4, a teardrop shape, a semi-circular shape, or any other suitable opening shape.

To use the low friction ring 20, two support ropes 8 are secured around the outer surface 32 within the path 38, and each support rope 8 is spliced and secured to a support location, as is commonly known. A rigging rope 6 is fed through the central passage 36 of the low friction ring 20 and secured to a load, as is commonly known. The radius 48 of the inside surface 34 allows for a smoother transition than prior art rings, thereby reducing the stress and wear on the rigging rope 6 as it passes therethrough.

The low friction ring 20 may be formed of any suitable material such as metals, including aluminum, aluminum alloys, titanium, steel or the like. The low friction ring 20 may also be formed by any commonly known method such as casting, machining or the like. One or both of the inside and outside surfaces, 32 and 34, may be treated to provide a low friction surface, such as, by way of non-limiting example, by anodizing, coating or the like as is commonly known.

While specific embodiments of the invention have been described and illustrated, such embodiments should be considered illustrative of the invention only and not as limiting the invention as construed in accordance with the accompanying claims.

What is claimed is:

1. An apparatus for supporting and redirecting a rigging rope comprising: a ring having an outer annular surface and a central passage extending between first and second side edges defining an inner surface; wherein said outer surface includes at least two circumferential grooves therearound; and wherein said inner surface has a curved cross-sectional profile extending between said first and second side edges, wherein said inner surface has a constant curve cross-sectional profile extending over a span of at least two of said circumferential grooves.

2. The apparatus of claim 1 wherein said central passage is round.

3. The apparatus of claim 1 wherein said central passage is elliptical.

4. The apparatus of claim 1 wherein each of said at least two circumferential grooves has a circular cross-sectional profile.

5. The apparatus of claim 1 wherein said at least two circumferential grooves are separated by a radial wall therebetween.

6. The apparatus of claim 1 wherein said ring is formed of a material selected from a group consisting of aluminum, aluminum alloys, titanium and steel.

7. The apparatus of claim 1 wherein said inner surface is treated to provide a low friction surface.

8. The apparatus of claim 7 wherein said inner surface is anodized.

9. The apparatus of claim 1 wherein said outer surface is treated to provide a low friction surface.

10. The apparatus of claim 9 wherein said outer surface is anodized.

* * * * *